US007419583B2

(12) United States Patent
Nieskens et al.

(10) Patent No.: US 7,419,583 B2
(45) Date of Patent: Sep. 2, 2008

(54) PROCESS FOR CATALYTICALLY REFORMING A HYDROCARBONACEOUS FEEDSTOCK

(75) Inventors: Martin Jean Pierre Cornelis Nieskens, Amsterdam (NL); Gerrit Jan Den Otter, Amsterdam (NL)

(73) Assignee: Shell Oil Company, Houston, TX (US)

( * ) Notice: Subject to any disclaimer, the term of this patent is extended or adjusted under 35 U.S.C. 154(b) by 612 days.

(21) Appl. No.: 10/508,159

(22) PCT Filed: Mar. 20, 2003

(86) PCT No.: PCT/EP03/03029

§ 371 (c)(1),
(2), (4) Date: Sep. 17, 2004

(87) PCT Pub. No.: WO03/078548

PCT Pub. Date: Sep. 25, 2003

(65) Prior Publication Data

US 2005/0139516 A1 Jun. 30, 2005

(30) Foreign Application Priority Data

Mar. 20, 2002 (EP) ..... 02251989

(51) Int. Cl.
*C10G 35/04* (2006.01)

(52) U.S. Cl. ..... 208/64

(58) Field of Classification Search ..... 208/63, 208/64, 65, 79
See application file for complete search history.

(56) References Cited

U.S. PATENT DOCUMENTS

| | | | | |
|---|---|---|---|---|
| 3,753,891 | A * | 8/1973 | Graven et al. | 208/62 |
| 4,133,841 | A * | 1/1979 | Cosyns et al. | 208/64 |
| 5,196,110 | A * | 3/1993 | Swart et al. | 208/65 |
| 5,354,451 | A | 10/1994 | Goldstein et al. | 208/65 |
| 6,179,995 | B1 * | 1/2001 | Cash et al. | 208/89 |

* cited by examiner

*Primary Examiner*—Walter D. Griffin
*Assistant Examiner*—Frank C Campanell
(74) *Attorney, Agent, or Firm*—Charles W. Stewart

(57) ABSTRACT

A process for catalytically reforming a gasoline boiling range hydrocarbonaceous feedstock in the presence of hydrogen involving the following steps:

Figure 1:
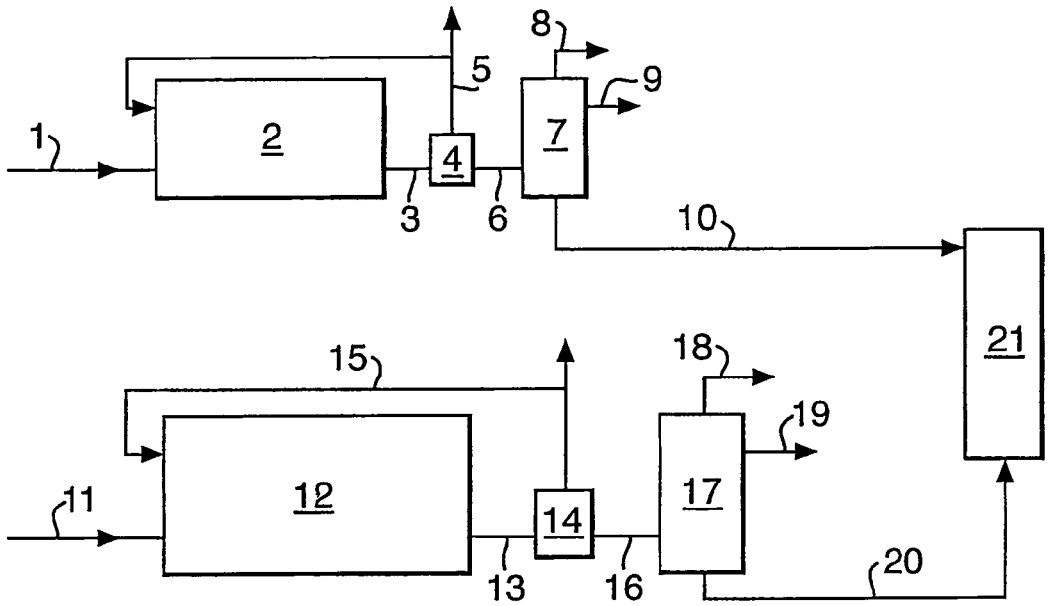

(a) reforming at least 5 vol % and at most 50 vol % of the feedstock in a first reforming unit having a fixed bed of catalyst particles;

(b) passing the effluent stream of the first reforming unit to a separation zone having a separator and a stabilizer to produce a hydrogen-rich gaseous stream, a $C_4^-$ hydrocarbon stream and a first reformate;

(c) reforming the remainder of the feedstock and at least part of the first reformate in a second reforming unit having one or more serially connected reaction zones, each having a moving catalyst bed, which are operated in a continuously catalyst regeneration mode; and, (d) passing the effluent stream of the second reforming unit to a separation zone having a separator and a stabilizer to produce a hydrogen-rich gaseous stream, a $C_4^-$ hydrocarbon stream and a second reformate.

32 Claims, 3 Drawing Sheets

PROCESS FOR CATALYTICALLY REFORMING A HYDROCARBONACEOUS FEEDSTOCK

The present invention relates to a process for catalytically reforming a gasoline boiling range hydrocarbonaceous feedstock in the presence of hydrogen.

A well-established refinery process for the production of gasoline having a high octane number is catalytic reforming. In catalytic reforming processes, a gasoline boiling range hydrocarbonaceous feedstock, typically the $C_6$-$C_{11}$ hydrocarbons of a hydrotreated naphtha, is contacted, in the presence of hydrogen, with a reforming catalyst under reforming conditions.

Catalytic reforming may be performed in fixed bed or moving bed reactors. Fixed bed reactors are usually operated in the semi-regenerative mode. A semi-regenerative (SR) reforming unit contains one or more fixed bed reactors and is operated by gradually increasing the temperature to compensate for catalyst deactivation. Finally, typically after a time period in the order of a year, the unit is shut down to regenerate and reactivate the catalyst. Alternatively, fixed bed reactors are operated in a cyclic mode, wherein one reactor is being regenerated whilst the other reactors remain on stream. Moving bed catalytic reforming is usually operated in combination with continuous catalyst regeneration. A continuous catalyst regeneration (CCR) reforming unit contains one or more moving bed reactors in series, typically 2 to 4. Catalyst is continuously added to and withdrawn from the reactors. The withdrawn catalyst is regenerated in a regeneration zone and then sent back to the reforming zone.

Continuous catalyst regeneration reforming units have a higher yield of reformate and the reformate has, under normal operating conditions, a higher octane number compared to semi-regenerative reforming units. For that reason, a lot of refineries have replaced their semi-regenerative reforming unit for a continuous catalyst regeneration reforming unit.

Over the past years, reforming catalysts have improved. This means that the catalyst in a reforming unit often can handle a larger amount of feedstock than for which the reforming unit was originally designed. If, however, a larger amount of feedstock would be reformed in that unit, the furnace capacity of the unit would be a bottleneck. Therefore, some continuous catalyst regeneration reforming units are nowadays operated at a lower throughput than the catalyst could handle.

In order to increase the amount of high octane gasoline produced by such a continuous catalyst regeneration reforming unit, it is necessary to use a different feed, i.e. a feed having less compounds that are converted in endothermic reactions, or to increase the furnace capacity.

It has now been found that it is possible to increase the amount of high octane gasoline produced by a continuous catalyst regeneration reforming unit significantly by reforming part of the feedstock in a semi-regenerative reforming unit before reforming it in the continuous catalyst regeneration reforming unit.

Accordingly, the present invention relates to a process for catalytically reforming a gasoline boiling range hydrocarbonaceous feedstock in the presence of hydrogen comprising the following steps:

(a) reforming at least 5 vol % and at most 50 vol % of the feedstock in a first reforming unit comprising a fixed bed of catalyst particles;

(b) passing the effluent stream of the first reforming unit to a separation zone comprising a separator and a stabiliser to produce a hydrogen-rich gaseous stream, a $C_4^-$ hydrocarbon stream and a first reformate;

(c) reforming the remainder of the feedstock and at least part of the first reformate in a second reforming unit comprising one or more serially connected reaction zones, each comprising a moving catalyst bed, which are operated in a continuously catalyst regeneration mode;

(d) passing the effluent stream of the second reforming unit to a separation zone comprising a separator and a stabiliser to produce a hydrogen-rich gaseous stream, a $C_4^-$ hydrocarbon stream and a second reformate.

It is an advantage of the process according to the present invention that no special feedstock and/or extra furnace capacity is needed to yield a larger amount of high octane gasoline. The process according to the present invention is particularly advantageous for refineries that have kept their semi-regenerative reforming unit after building a continuous catalyst regeneration reforming unit, since the increased yield in high octane gasoline can then be obtained by using existing units.

U.S. Pat. No. 5,354,451 discloses a process wherein a semi-regenerative reforming unit and a continuous catalyst regeneration reforming unit are placed in series and all feedstock is first led through the semi-regenerative reforming unit. In the process of U.S. Pat. No. 5,354,451, the hydrogen-rich gas separated from the first reformate is led to the continuous catalyst regeneration reforming unit and the first reformate is not stabilised.

A disadvantage of the process of U.S. Pat. No. 5,354,451 is that the whole feedstock is led through the semi-regenerative reforming unit. This results in a lower yield and a lower octane number as compared to the process according to the present invention, since more $C_4^-$ hydrocarbons (yield loss) and $C_5$ hydrocarbons (cannot contribute to increase of octane number in the CCR reforming unit) are formed in the semi-regenerative reforming unit.

In the process according to the present invention, the feedstock for the first and the second reforming unit is a gasoline boiling range hydrocarbonaceous feedstock, preferably a hydrotreated naphtha from which the $C_5^-$ hydrocarbons have been separated.

The first reforming unit has at least one fixed bed of catalyst. The first reforming unit may be a cyclic reforming unit or a semi-regenerative reforming unit. Such reforming units are known in the art. A semi-regenerative reforming unit typically has 2 to 4 reactors or reaction zones, each comprising a fixed bed of reforming catalyst. Catalysts and process conditions suitable for fixed bed reforming are known in the art.

The effluent of the first reforming unit is passed to a separation zone to separate hydrogen and light hydrocarbons from it in order to obtain a first reformate that contains mainly $C_5^+$ hydrocarbons, preferably mainly $C_7^+$ hydrocarbons.

Typically, the effluent of the first reforming unit is first led to a separator, wherein a hydrogen-rich gaseous stream is separated from it, and then to a stabiliser to fractionate it into a fuel gas mainly comprising $C_1$ and $C_2$ hydrocarbons, a $C_4^-$ hydrocarbons stream and a $C_5^+$ hydrocarbons stream. This $C_5^+$ hydrocarbons stream may be passed to the second reforming unit as the first reformate.

Preferably, also the $C_5$ and $C_6$ hydrocarbons are separated from the $C_5^+$ hydrocarbons stream to obtain a $C_7^+$ hydrocarbons stream as the first reformate. Since the paraffinic $C_5$ and $C_6$ hydrocarbons have a relatively low octane number that cannot be improved much further in catalytic reforming, removal of these low octane components from the first reformate will lead to a higher octane number of the second reformate. A further advantage is that benzene formation in the second reforming unit is minimised.

An alternative way of introducing a first reformate containing mainly $C_7^+$ to the second reforming unit is to combine the $C_5^+$ first reformate with the remainder of the feedstock and passing this combined stream to a naphtha splitter to separate the $C_5$-$C_6$ hydrocarbons from it. The thus-obtained $C_7^+$ hydrocarbon stream is then led to the second reforming unit.

The hydrogen-rich gaseous stream obtained in the separator typically contains 70-90 vol % of hydrogen and is preferably partly recycled to the first reforming unit.

The first reformate is, together with at least 50% of the total feedstock, reformed in the second reforming unit. The second reforming unit is a continuous catalyst regeneration reforming unit comprising one or more reactors or reaction zones, typically 2 to 4, each comprising a moving bed of catalyst. Catalysts and process conditions suitable for continuous catalyst regeneration reforming are known in the art.

If the second reforming unit contains more than one reaction zones, it is preferred that the first reformate is fed to the second or a further downstream reaction zone. An advantage of feeding the first reformate to the second or further downstream reaction zone is that less furnace capacity is needed for the first reaction zone.

Preferably at least 90 vol % of the first reformate is reformed in the second reforming unit, more preferably the whole first reformate.

The effluent of the second reforming unit is passed to a separation zone to separate hydrogen and light hydrocarbons from it in order to obtain a second reformate that contains mainly $C_5^+$ hydrocarbons. The hydrogen-rich gaseous stream obtained in the separator typically contains 70-90 vol % of hydrogen and is preferably partly recycled to the second reforming unit.

It has been found that the aim of the present invention, i.e. increasing the yield of high octane gasoline without having to increase the furnace capacity of the CCR reforming unit, can be achieved if at least 5 vol % and at most 50% of the feedstock is reformed in a SR reforming unit before being further reformed in the CCR reforming unit. Preferably 5-30% of the feedstock is reformed in the first reforming unit before being further reformed in the second reforming unit, more preferably 10-25%.

The first reformate that is introduced into the second reforming unit typically has a research octane number in the range of from 90-100. The second reformate has a higher research octane number than the first reformate.

The invention will be illustrated by means of the following Figures.

FIG. 1 schematically shows a process not according to the invention wherein part of the naphtha feedstock is reformed in a semi-regenerative reforming unit and part in a CCR reforming unit and wherein the thus-obtained reformate streams are combined.

Figure 2:
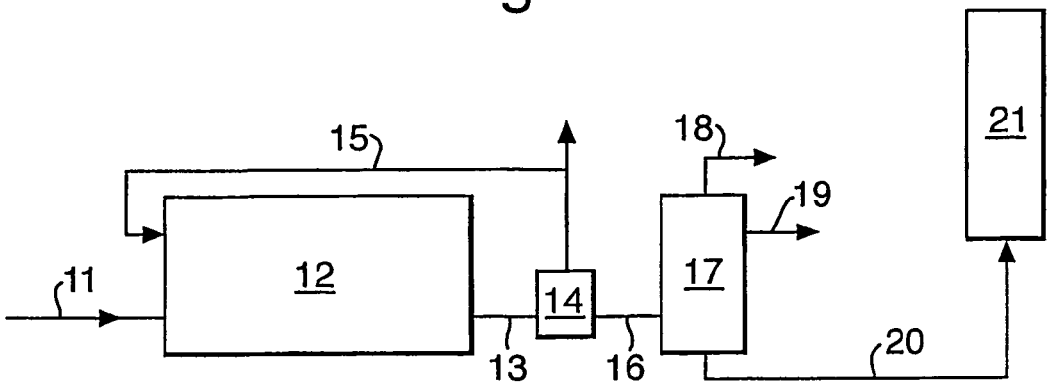

FIG. 2 schematically shows a process not according to the invention wherein the whole naphtha feedstock is reformed in a CCR reforming unit.

Figure 3:
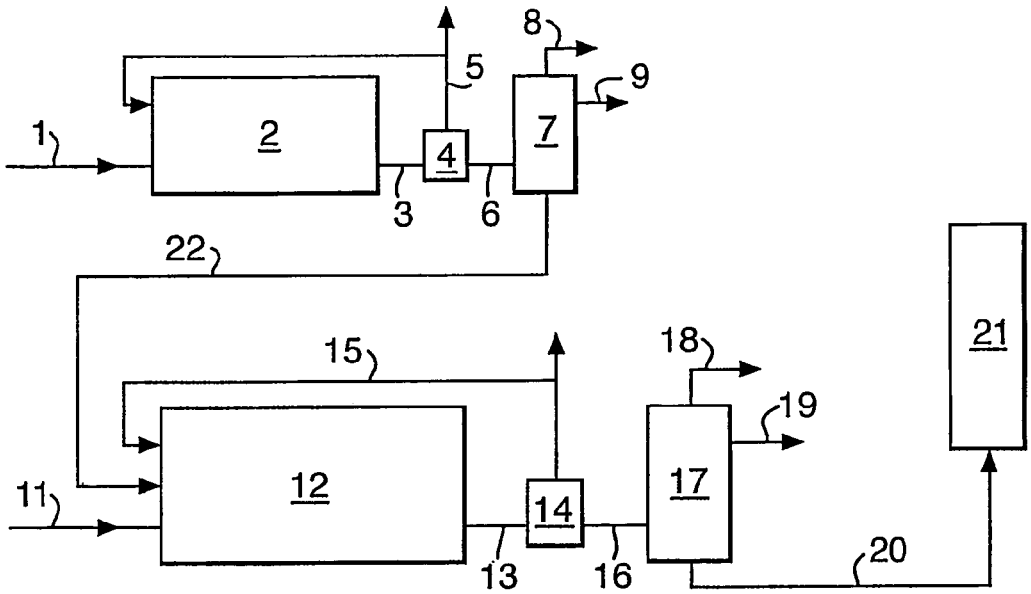

FIG. 3 schematically shows a process according to the invention wherein $C_5^+$ SR reformate is reformed in a CCR reforming unit together with the remainder of the feedstock.

Figure 4:
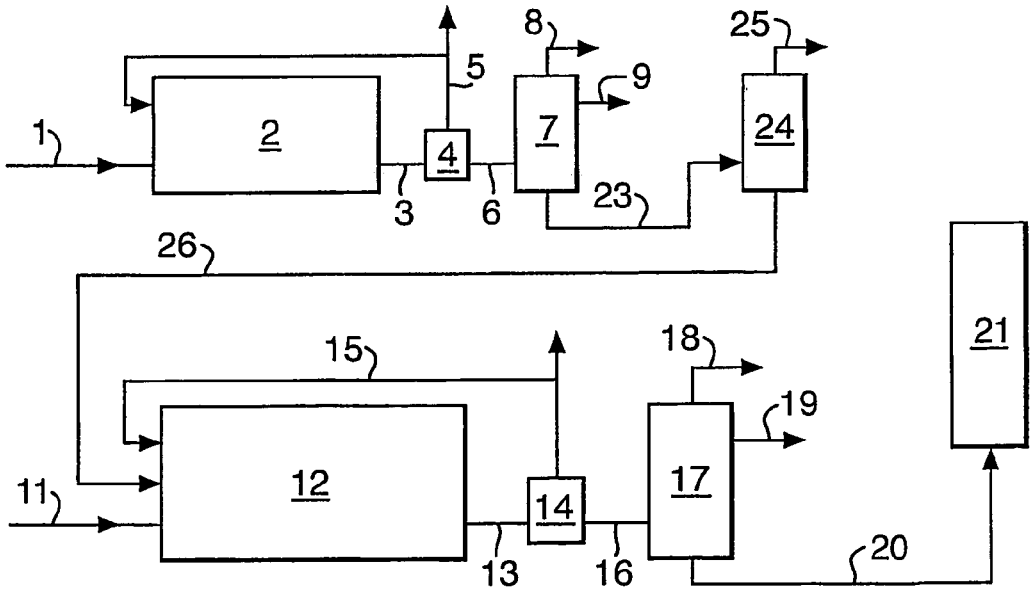

FIG. 4 schematically shows a process according to the invention wherein $C_7^+$ SR reformate is reformed in a CCR reforming unit together with the remainder of the feedstock.

Figure 5:
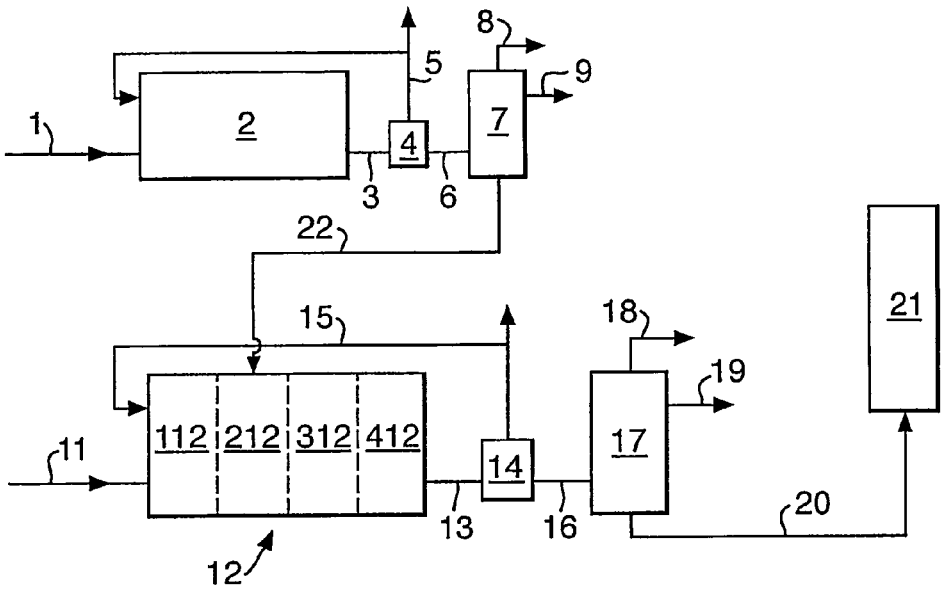

FIG. 5 schematically shows a process according to the invention wherein $C_5^+$ SR reformate is introduced in the second reaction zone of a CCR reforming unit having four reaction zones.

Figure 6:
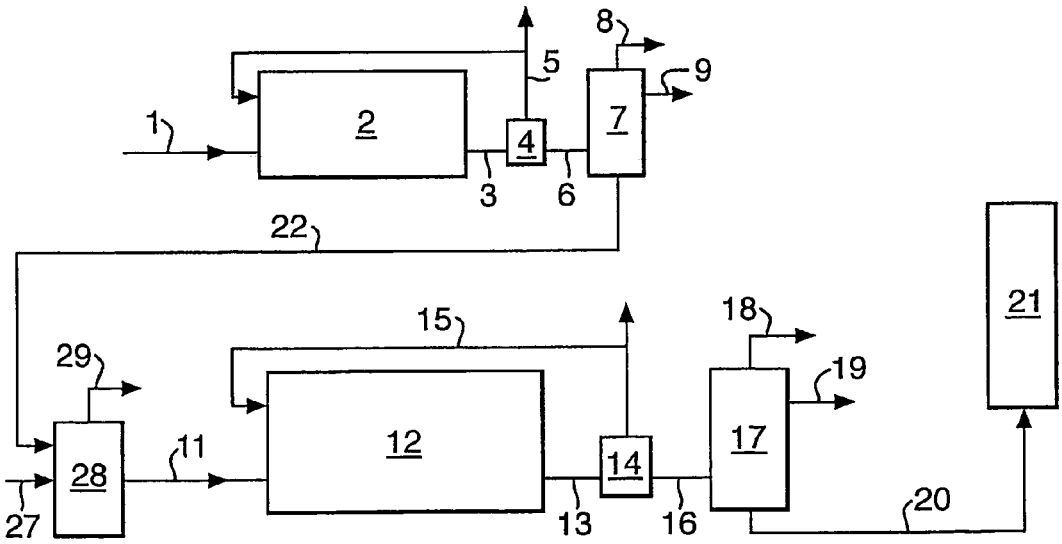

FIG. 6 schematically shows a process according to the invention wherein $C_5^+$ SR reformate is passed to a naphtha splitter before being introduced in the CCR reforming unit.

In FIG. 1 a first stream of gasoline boiling range hydrocarbonaceous feedstock is introduced via line 1 in semi-regenerative reforming unit 2. The effluent is led via line 3 to separator 4, wherein a hydrogen-rich gaseous stream is separated off via line 5 and partly recycled to reforming unit 2. The thus-obtained hydrocarbon stream is led via line 6 to stabiliser 7. In stabiliser 7, the hydrocarbon stream is fractionated into fuel gas, a $C_4^-$ hydrocarbons stream, and a $C_5^+$ reformate. The fuel gas is withdrawn via line 8, the $C_4^-$ hydro-carbons stream via line 9, and the reformate is sent to gasoline pool 21 via line 10. A second stream of gasoline boiling range hydrocarbonaceous feedstock is introduced via line 11 in CCR reforming unit 12. The effluent of reforming unit 12 is led via line 13 to separator 14, wherein a hydrogen-rich gaseous stream is separated from the effluent and recycled to reforming unit 12 via line 15. The thus-obtained hydrocarbon stream is led via line 16 to stabiliser 17. In stabiliser 17, the hydrocarbon stream is fractionated into fuel gas, a $C_4^-$ hydrocarbons stream, and a $C_5^+$ reformate. The fuel gas is withdrawn via line 18, the $C_4^-$ hydrocarbons stream via line 19, the reformate is sent to gasoline pool 21 via line 20.

In the process scheme of FIG. 2, all feedstock is introduced via line 11 in CCR reforming unit 12. The effluent of reforming unit 12 is led via line 13 to separator 14, wherein a hydrogen-rich gaseous stream is separated from the effluent and partly recycled to reforming unit 12 via line 15. The thus-obtained hydrocarbon stream is led via line 16 to stabiliser 17. In stabiliser 17, the hydrocarbon stream is fractionated into fuel gas, a $C_4^-$ hydrocarbons stream, and a $C_5^+$ reformate. The fuel gas is withdrawn via line 18, the $C_4^-$ hydrocarbons stream via line 19, the reformate is sent to gasoline pool 21 via line 20.

In the process according to the invention as shown in FIG. 3, the first reformate obtained in stabiliser 7 is passed via line 22 to CCR reforming unit 12 and reformed in unit 12 together with the feedstock that is introduced in reforming unit 12 via line 11.

The process according to the invention as shown in FIG. 4 is similar to the process of FIG. 3. The difference is that the $C_5^+$ hydrocarbons stream obtained in stabiliser 7 is led via line 23 to fractionator 24 to obtain a $C_5$-$C_6$ hydrocarbons stream and a $C_7^+$ first reformate. The $C_5$-$C_6$ hydrocarbons stream is withdrawn via line 25 and the $C_7^+$ first reformate is led via line 26 to CCR reforming unit 12. The $C_5$-$C_6$ hydrocarbons stream may be sent to gasoline pool 21 (not shown).

In the process according to the invention as shown in FIG. 5, the CCR reforming unit 12 has four reaction zones 112, 212, 312, and 412. The $C_5^+$ reformate obtained in stabiliser 7 is led via line 22 to the second reaction zone 212 of CCR reforming unit 12.

In the process according to the invention as shown in FIG. 6, hydrotreated, debutanised naphtha is led via line 27 to naphtha splitter 28. The $C_5^+$ first reformate is led to naphtha splitter 28 via line 22. In the naphtha splitter, a $C_5$-$C_6$ hydrocarbon stream is separated from the combined streams and withdrawn via line 29 and a $C_7^+$ hydrocarbons stream is produced and led via line 11 to CCR reforming unit 12.

The process according to the invention will be further illustrated by means of the following examples.

EXAMPLE 1

Comparative

In a process as shown in FIG. 1, a stream of 350 t/d hydrotreated naphtha substantially boiling in the gasoline range is introduced via line 1 in semi-regenerative reforming unit 2. A stream of 1500 t/d of the same hydrotreated naphtha substantially boiling in the gasoline range is introduced via line 11 in the first reaction zone of CCR reforming unit 12 having three reaction zones (not shown). CCR reforming unit 12 is operated at a pressure of 9.7 barg, a liquid hourly space velocity (LHSV) of 1.5 $h^{-1}$, and a hydrogen/oil ratio of 2.5 mole/mole. A stream of 263 t/d SR reformate having a RON of 100.0 is withdrawn via line 10 and a stream of 1292 t/d CCR reformate having a RON of 103.9 via line 20. Combining the SR and CCR reformate results in a reformate stream of 1555 t/d with a research octane number of 103.2.

EXAMPLE 2

Comparative

In a process as shown in FIG. 2, a stream of 1800 t/d of the same naphtha as used in example 1 is introduced via line 11 in the first reaction zone of CCR reforming unit 12 having three reaction zones (not shown). CCR reforming unit 12 is operated at a pressure of 9.7 barg, a liquid hourly space velocity (LHSV) of 1.8 $h^{-1}$, and a hydrogen/oil ratio of 2.08 mole/mole. A stream of 1569 t/d CCR reformate is sent via line 20 to gasoline pool 21. The RON of this reformate is 102.8.

EXAMPLE 3

According to the Invention

In a process as shown in FIG. 3, a stream of 350 t/d of the same naphtha as used in example 1 is introduced via line 1 in semi-regenerative reforming unit 2, a stream of 1500 t/d naphtha is introduced via line 11 in the first reaction zone of CCR reforming unit 12, and a stream of 263 t/d $C_5^+$ SR reformate having a RON of 100.0 is introduced via line 22 in the first reaction zone of CCR reforming unit 12 having three reaction zones (not shown). CCR reforming unit 12 is operated at a pressure of 9.7 barg, a liquid hourly space velocity (LHSV) of 1.8 $h^{-1}$, and a hydrogen/oil ratio of 2.13 mole/mole. A stream of 1541 t/d CCR reformate is sent via line 20 to gasoline pool 21. The RON of this reformate is 104.2.

EXAMPLE 4

According to the Invention

In a process as shown in FIG. 4, a stream of 350 t/d of the same naphtha as used in example 1 is introduced via line 1 in semi-regenerative reforming unit 2, a stream of 1500 t/d naphtha is introduced via line 11 in the first reaction zone of CCR reforming unit 12. A stream of 218 t/d of first reformate mainly comprising $C_7^+$ hydrocarbons is introduced via line 26 in the first reaction of CCR reforming unit 12. CCR reforming unit 12 is operated at a pressure of 9.7 barg, a liquid hourly space velocity (LHSV) of 1.7 $h^{-1}$, and a hydrogen/oil ratio of 2.19 mole/mole. A stream of 1502 t/d CCR reformate is led via line 20 to gasoline pool 21. This reformate has a RON of 105.1.

In Table 1, the Total Octane tons 97+ of the reformate sent to gasoline pool 21 is shown for Examples 1 to 4. It can be seen that the process according to the inventions results in a significant higher number of 97+ octane tons than the prior art processes of Examples 1 and 2.

TABLE 1

| | Total Octane tons 97+ | | | |
|---|---|---|---|---|
| | Example 1 (comparative) | Example 2 (comparative) | Example 3 (invention) | Example 4 (invention) |
| Total Octane tons 97+ | 9 702 | 9 103 | 11 097 | 12 169 |

We claim:

1. A process for catalytically reforming a gasoline boiling range hydrocarbonaceous feedstock in the presence of hydrogen comprising the following steps:

(a) reforming a first feedstock, which is at least 5 vol % and at most 50 vol % of the gasoline boiling range hydrocarbonaceous feedstock to said process, in a first reforming unit comprising a fixed bed of catalyst particles;

(b) passing the effluent stream of the first reforming unit to a separation zone comprising a separator and a stabilizer to produce a hydrogen-rich gaseous stream, a C4– hydrocarbon stream and a first reformate;

(c) reforming a second feedstock, which is at least 50 vol % of the gasoline boiling range hydrocarbonaceous feedstock to said process, and at least part of the first reformate from step (b) in a second reforming unit comprising one or more serially connected reaction zones, each comprising a moving catalyst bed, which are operated in a continuously catalyst regeneration mode; and (d) passing the effluent stream of the second reforming unit to a separation zone comprising a separator and a stabilizer to produce a hydrogen-rich gaseous stream, a C4– hydrocarbon stream and a second reformate.

2. The process of claim 1, wherein at least part of the hydrogen-rich gaseous stream obtained in step (b) is recycled to the first reforming unit.

3. The process of claim 2, wherein at least part of the hydrogen-rich gaseous stream obtained in step (d) is recycled to the second reforming unit.

4. The process of claim 3, wherein the first reformate mainly comprises $C_5^+$ hydrocarbons.

5. The process of claim 3, wherein also a $C_5$-$C_6$ hydrocarbon stream is produced in the separation zone of step (b) and the first reformate mainly comprises $C_7^+$ hydrocarbons.

6. The process of claim 1, wherein at least 90 vol % of the first reformat is reformed in the second reforming unit.

7. The process of claim 4, wherein at least part of the first reformate is combined with said second feedstock and passed to a naphtha splitter to produce a C7+ hydrocarbon stream which is then reformed in the second reforming unit in step (c).

8. The process of claim 7, wherein at least 90 vol % of the first reformate is passed to the naphtha splitter.

9. The process of claims 6, wherein the second reforming unit has at least two serially connected reaction zones and wherein the first reformate is introduced into the second or a further downstream reaction zone.

10. The process of claim 1, wherein said first feedstock is 5-30 vol % of the gasoline boiling range hydrocarbonaceous feedstock to said process is reformed in the first reforming unit.

11. The process of claim 1, wherein at least part of the hydrogen-rich gaseous stream obtained in step (d) is recycled to the second reforming unit.

12. The process of claim 1, wherein the first reformate mainly comprises C5+ hydrocarbons.

13. The process of claim 2, wherein the first reformate mainly comprises C5+ hydrocarbons.

14. The process of claim 1, wherein also a C5-C6 hydrocarbon stream is produced in the separation zone of step (b) and the first reformate mainly comprises C7+ hydrocarbons.

15. The process of claim 2, wherein also a C5-C6 hydrocarbon stream is produced in the separation zone of step (b) and the first reformate mainly comprises C7+ hydrocarbons.

16. The process of claim 2, wherein at least 90 vol % of the first reformate is reformed in the second reforming unit.

17. The process of claim 3, wherein at least 90 vol % of the first reformate is reformed in the second reforming unit.

18. The process of claim 4, wherein at least 90 vol % of the first reformate is reformed in the second reforming unit.

19. The process of claim 5, wherein at least 90 vol % of the first reformate is reformed in the second reforming unit.

20. The process of claim 1, wherein the second reforming unit has at least two serially connected reaction zones and wherein the first reformate is introduced into the second or a further downstream reaction zone.

21. The process of claim 2, wherein the second reforming unit has at least two serially connected reaction zones and wherein the first reformate is introduced into the second or a further downstream reaction zone.

22. The process of claim 3, wherein the second reforming unit has at least two serially connected reaction zones and wherein the first reformate is introduced into the second or a further downstream reaction zone.

23. The process of claim 4, wherein the second reforming unit has at least two serially connected reaction zones and wherein the first reformate is introduced into the second or a further downstream reaction zone.

24. The process of claim 5, wherein the second reforming unit has at least two serially connected reaction zones and wherein the first reformate is introduced into the second or a further downstream reaction zone.

25. The process of claim 2, wherein said first feedstock is 5 -30 vol % of the gasoline boiling range hydrocarbonaceous feedstock to said process is reformed in the first reforming unit.

26. The process of claim 3, wherein said first feedstock is 5-30 vol % of the gasoline boiling range hydrocarbonaceous feedstock to said process is reformed in the first reforming unit.

27. The process of claim 4, wherein said first feedstock is 5-30 vol % of the gasoline boiling range hydrocarbonaceous feedstock to said process is reformed in the first reforming unit.

28. The process of claim 5, wherein said first feedstock is 5-30 vol % of the gasoline boiling range hydrocarbonaceous feedstock to said process is reformed in the first reforming unit.

29. The process of claim 6, wherein said first feedstock is 5-30 vol % of the gasoline boiling range hydrocarbonaceous feedstock to said process is reformed in the first reforming unit.

30. The process of claim 7, wherein said first feedstock is 5-30 vol % of the gasoline boiling range hydrocarbonaceous feedstock to said process is reformed in the first reforming unit.

31. The process of claim 8, wherein said first feedstock is 5-30 vol % of the gasoline boiling range hydrocarbonaceous feedstock to said process is reformed in the first reforming unit.

32. The process of claim 9, wherein said first feedstock is 5-30 vol % of the gasoline boiling range hydrocarbonaceous feedstock to said process is reformed in the first reforming unit.

* * * * *